US007743450B2

(12) United States Patent
Rouillard et al.

(10) Patent No.: US 7,743,450 B2
(45) Date of Patent: Jun. 29, 2010

(54) CLEANING BULLET

(75) Inventors: Carol A. Rouillard, Loveland, OH (US); Ronald R. Dir, Sturtevant, WI (US); James M. Scolaro, Racine, WI (US); David Gennrich, Middleton, WI (US); Dan Bullis, Madison, WI (US); Aaron Kurth, Menomonie, WI (US)

(73) Assignee: Diversey, Inc., Sturtevant, WI (US)

( * ) Notice: Subject to any disclaimer, the term of this patent is extended or adjusted under 35 U.S.C. 154(b) by 638 days.

(21) Appl. No.: 11/746,826

(22) Filed: May 10, 2007

(65) Prior Publication Data

US 2007/0251038 A1 Nov. 1, 2007

Related U.S. Application Data

(63) Continuation-in-part of application No. 11/226,474, filed on Sep. 14, 2005.

(51) Int. Cl.
*B08B 9/02* (2006.01)

(52) U.S. Cl. ..... 15/104.03; 15/104.05; 15/104.061; 15/104.16

(58) Field of Classification Search ..... 134/8, 134/22.1, 22.11, 22.12; 15/104.061, 104.062, 15/104.03, 104.05, 104.16
See application file for complete search history.

(56) References Cited

U.S. PATENT DOCUMENTS

| | | | | |
|---|---|---|---|---|
| 2,408,240 | A | 9/1946 | Stone | 15/88 |
| 3,543,323 | A | 12/1970 | Girard | 15/104.06 |
| 3,875,606 | A | 4/1975 | Landers | 15/104.06 |
| 4,083,074 | A | 4/1978 | Curtis | 15/104.06 |
| 4,208,755 | A | 6/1980 | Shephered | |
| 4,244,073 | A | 1/1981 | Sagawa | 15/104 |
| 4,365,379 | A | 12/1982 | Neff | |
| 5,140,718 | A | 8/1992 | Toth | |
| 5,161,919 | A | 11/1992 | Smith et al. | 406/86 |
| 5,208,936 | A | 5/1993 | Campbell | |
| 5,244,505 | A | 9/1993 | Allison et al. | 134/22.11 |
| 5,457,841 | A | 10/1995 | Minton | 15/104.061 |
| 5,484,237 | A | 1/1996 | Langenbeck | 406/86 |
| 5,625,917 | A * | 5/1997 | Hawkins | 15/104.061 |

(Continued)

FOREIGN PATENT DOCUMENTS

| | | |
|---|---|---|
| DE | 25 44 878 A1 | 4/1977 |

(Continued)

OTHER PUBLICATIONS

The International Search Report from the Korean Intellectual Property Office.

*Primary Examiner*—Michael Barr
*Assistant Examiner*—Saeed T Chaudhry
(74) *Attorney, Agent, or Firm*—Gregory S. Bollis

(57) ABSTRACT

A cleaning bullet for use in a pipe or track includes a compressible body. In one embodiment, a sheet draped over the body is engageable with interior walls of the pipe or track to clean small contaminants. In another embodiment, the body is formed from an absorbent material that absorbs a fluid, such as a cleaning solution, that can clean and/or disinfect the interior walls of the pipe or track. In yet another embodiment, an alignment key extends radially from a body axis for guiding the cleaning bullet in an air conveyor track.

12 Claims, 13 Drawing Sheets

U.S. PATENT DOCUMENTS

| | | | | |
|---|---|---|---|---|
| 5,695,302 | A | 12/1997 | Hilbish | 406/88 |
| 6,176,938 | B1 | 1/2001 | Palmer | 134/8 |
| 6,332,740 | B1 | 12/2001 | Bernard et al. | 406/88 |
| 6,368,027 | B1 | 4/2002 | Trenel et al. | 406/87 |
| 6,500,271 | B1 * | 12/2002 | Moore et al. | 134/8 |
| 6,514,015 | B1 | 2/2003 | Trenel et al. | 406/86 |
| 6,527,869 | B1 | 3/2003 | Bourg | 134/1 |
| 6,890,128 | B2 | 5/2005 | Seidl et al. | 406/88 |
| 2004/0074030 | A1 | 4/2004 | Nehrbass | 15/104.062 |
| 2004/0115012 | A1 | 6/2004 | Seidl et al. | 406/86 |
| 2007/0056606 | A1 | 3/2007 | Rouillard et al. | |

FOREIGN PATENT DOCUMENTS

| | | |
|---|---|---|
| EP | 1 102 018 A | 5/2001 |
| JP | 60-082527 | 5/1985 |
| JP | 2002-192095 | 7/2002 |

* cited by examiner

CLEANING BULLET

CROSS REFERENCES TO RELATED APPLICATIONS

This application is a continuation-in-part of U.S. Ser. No. 11/226,474 filed on Sep. 14, 2005.

STATEMENT REGARDING FEDERALLY SPONSORED RESEARCH

Not Applicable.

TECHNICAL FIELD

This invention relates to pipe and elongated track cleaning, and in particular to a cleaning bullet propelled through the pipe or track to clean the interior of the pipe or track.

DESCRIPTION OF THE BACKGROUND ART

Air conveyor systems are often used in the beverage industry to transport bottles by the bottle neck. These conveyor systems typically include elongated tracks defining a longitudinal slot through which the neck of the bottle extends. Compressed air directed at various portions of the bottle urges the bottle along a conveyor path. The interior of the track often accumulate dust, microorganisms, and other contaminants during operation which can enter the bottles and contaminate the product contained therein and impede bottle movement. As a result, the track must be cleaned on a regular basis to ensure the proper operation and sanitation of the track. Track cleaning is currently done manually by laboriously wiping the track with a dampened cloth. Since the air conveyor system track is typically overhead, this cleaning requires the use of lift devices that increase the time and cost of the cleaning.

Pipeline pigs are often used to clean the interior surfaces of long stretches of pipe. The pig is propelled through the pipe by a compressed fluid to dislodge contaminants adhering to pipe interior walls. The pigs typically include a body having an outer circumference that conforms with the interior of the pipe being cleaned. Unfortunately, these pigs must be in an enclosed pipe in order to operate effectively and small contaminants are often left undisturbed. Accordingly, the use of known pipeline pigs in an air conveyor track will not sufficiently clean an air conveyor track. Therefore, a need exists for a cleaning device that can operate efficiently in slotted tracks and pipes to clean small contaminants, such as dust and microorganisms.

SUMMARY OF THE INVENTION

The present invention provides a cleaning bullet having a compressible body. In one embodiment, a sheet draped over the body is engageable with interior walls of the pipe or track to clean small contaminants. In another embodiment, the body is formed from an absorbent material that absorbs a fluid, such as a cleaning solution, that can clean and/or disinfect the interior walls of the pipe or track. In yet another embodiment, an alignment key extends radially from a body axis for guiding the cleaning bullet in an air conveyor track. In still another embodiment, the body is formed from a pleated, hollow, undulating body. In a still further embodiment, the body and the sheet are disposable. In yet another embodiment, the body is formed from a plurality of rod members connected to a nose member.

A method for cleaning an interior wall of a pipe or track is also provided.

A general objective of the present invention is to provide a cleaning bullet that can operate effectively in slotted tracks and pipes to clean small contaminants, such as dust and microorganisms. This objective is accomplished in one embodiment by draping a disposable sheet, such as formed from a micro fiber material, over the body for wiping the interior walls of the pipe or track. The sheet can contain a cleaning solution which is distributed on the pipe or track. In another embodiment, this objective is accomplished by forming the body from an absorbent material and soaking the body in a fluid, such as a cleaning solution, which is then applied to the interior walls of the pipe or track.

Another objective of the present invention is to provide a cleaning bullet that can be used in an air conveyor track. This objective is accomplished in one embodiment by providing an alignment key extending radially from the body axis, wherein the alignment key is engageable with the track to guide the cleaning bullet along the track.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENTS

Figure 1:
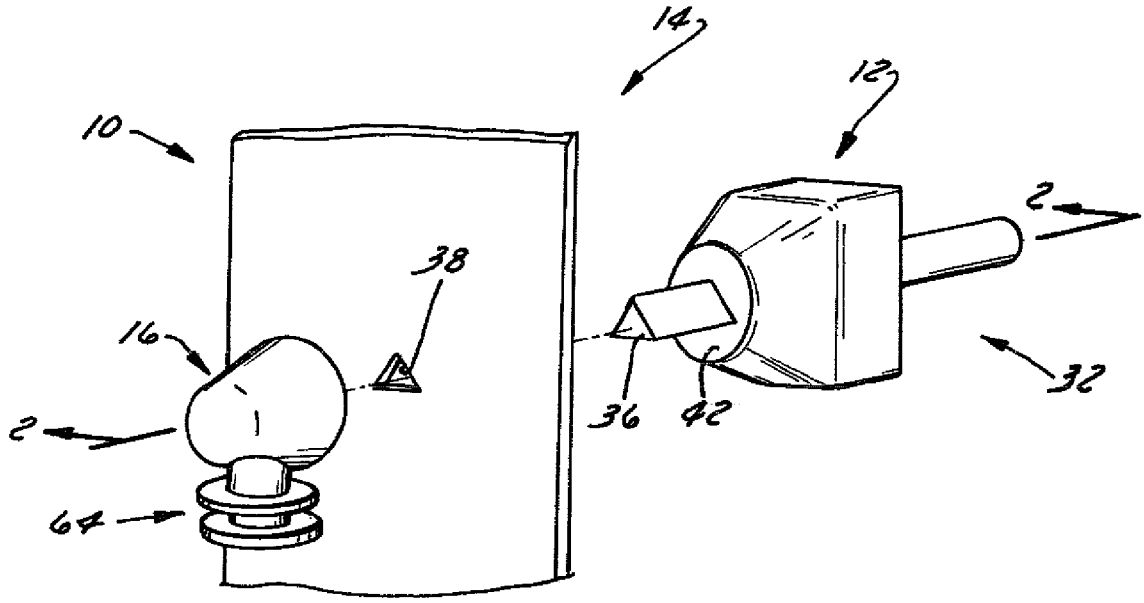
FIG. 1 is a perspective exploded view of a cleaning bullet incorporating the present invention.
Figure 2:
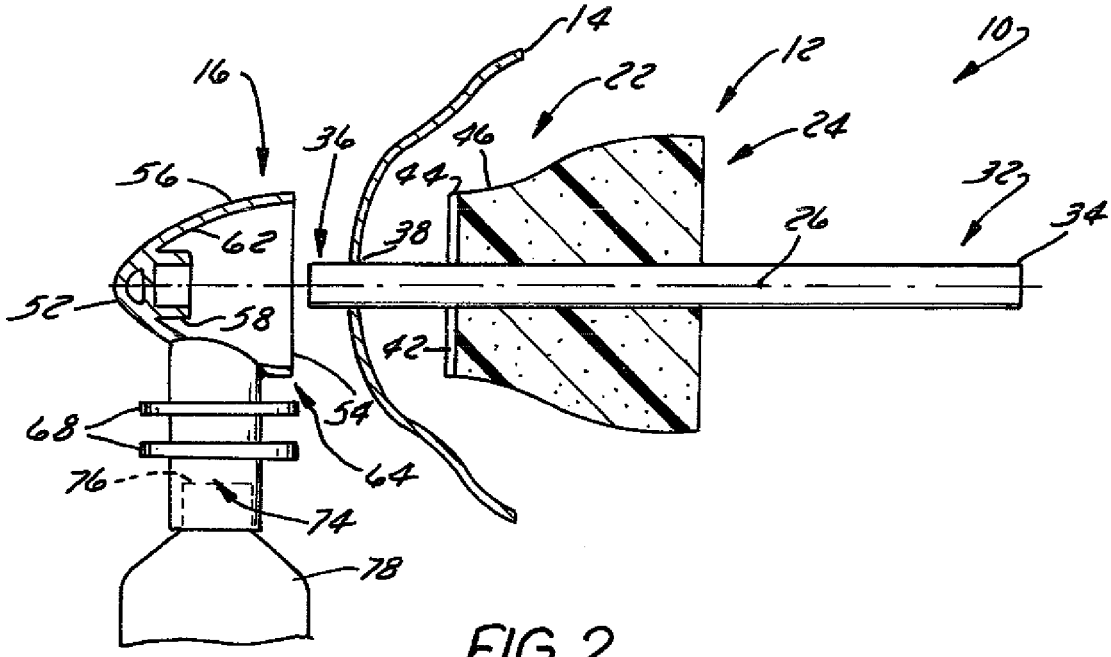
FIG. 2 is a sectional view along line 2-2 of FIG. 1.

A cleaning bullet 10, shown in FIGS. 1 and 2, incorporating the present invention is suitable for use in pipes and slotted tracks. The bullet 10 includes a body 12 propelled through the pipe or track. A disposable sheet 14 fixed to the body 12 engages the pipe or track interior walls to dislodge contaminant, particles, and the like, from the walls and clean the pipe or track interior. A nose 16 fixed relative to the body 12 secures the sheet 14 relative to the body 12.

The body 12 is formed from a compressible material that biases the sheet 14 against the pipe or track interior walls. In a preferred embodiment, the body 12 is formed, such as by molding, thermoforming, and the like, from an absorbent sponge-like material, such as foamed polyurethane, that can be saturated with a fluid, such as water or a solution containing a cleaning fluid, that will clean, or even disinfect, the pipe or track interior walls on contact. Advantageously, the compressible body 12 allows the same bullet to be used in pipe or track having different cross sections and diameters.

In the embodiment disclosed herein, the body 12 includes a frustoconical leading end 22 that forms into a square trailing end 24 along a body axis 26 for use in a track having a square cross section. Of course, the shape of the trailing end 24 can be formed to conform to the particular shape of the pipe or track being cleaned. For example, a bullet 10 having a circular trailing end is more suitable for use in a pipe having a circular cross section.

A handle 32 extending rearwardly from the body trailing end 24 substantially coaxial with the body axis 26 simplifies inserting the bullet 10 into the pipe or track. The handle 32 is preferably, an elongated rigid rod 34 formed from any suitable material, such as wood, plastic, metal, and the like, around which the body 12 is formed. In the embodiment disclosed herein, the rod extends forwardly past the leading end 22 of the body 12 to form a peg 36 for fixing the disposable sheet 14 relative to the body 12 and mounting the nose 16 thereon.

The disposable sheet 14 is draped over the leading end 22 of the body 12 and extends rearwardly over the body 12 to clean the interior walls of the pipe or track. Advantageously, the compressible body 12 urges the sheet 14 against the interior walls to effectively clean the interior walls and moves the bullet 10 through the pipe or track. Preferably, the sheet 14 is formed from a micro fiber material that is known to efficiently clean surfaces and form fitted to the body 12 to minimize bunching and the resulting excess friction due to the bunched sheet 14. However, the sheet 14 can be formed from any material suitable for the particular application, such as paper, plastic, natural material, synthetic material, woven material, non-woven material, fabric, and the like. An aperture 38 die cut through the sheet 14 receives the peg 36 to locate and fix the sheet 14 relative to the body 12. Advantageously, the sheet 14 can be used dry or soaked in a fluid, such as water, a cleaning solution, and the like, that can clean and/or disinfect the interior walls of the pipe or track. The sheet 14 can be soaked prior to fixing it to the cleaning bullet body 12 or if the body 12 is formed from an absorbent material, receive fluid absorbed in the body 12.

A circular front plate 42 fixed to the leading end 22 of the body 12 couples with the nose 16 to secure the disposable sheet 14 relative to the body 12. The front plate 42 is formed from any suitable material, such as plastic, and has a peripheral edge 44 aligned with a peripheral edge 46 of the leading end 22 of the body 12. The circular front plate 42 can be formed as an integral part of the rod 34, as a separate part, or eliminated without departing from the scope of the invention.

The nose 16 is detachably mounted to the peg 36 and couples with the front plate 42 to secure the sheet 14 relative to the body 12. The nose 16 includes a closed rounded leading end 52 joined to an open trailing end 54 by a nose wall 56. The open trailing end 54 couples with the front plate 42 to pinch the sheet 14 between the nose 16 and the front plate peripheral edge 44. A receptacle 58 extending rearwardly from an inner surface 62 of the nose leading end 52 receives the peg 36 to mount the nose 16 relative to the body 12, and retains the nose 16 on the peg 36 using a friction fit. Of course, other methods for fixing the nose 16 relative to the body 12 can be used, such as threads, mechanical fasteners, a snap fit, adhesive, and the like, without departing from the scope of the invention.

The embodiment disclosed in FIGS. 1 and 2 includes an alignment key 64 especially suited for guiding the cleaning bullet 10 in a air conveyor track having a longitudinal slot for conveying objects, such as beverage bottles. The alignment key 64 is preferably formed as an integral part of the nose 16, and includes a shaft 66 extending radially relative to the body axis 26 and downwardly from the nose wall 56 into the longitudinal slot of the track. Spaced discs 68 formed proximal a distal end 72 of the shaft 66 engage the track in a manner similar to the objects conveyed by the air conveyor.

The alignment key 64 centers the bullet 10 in the track to maintain the disposable sheet 14 in contact with the track interior walls. Of course, the shape of the alignment key 64 can be modified for use in other tracks without departing from the scope of the invention. Although forming the alignment key 64 as an integral part of the nose 16 is preferred, the alignment key 64 can be formed independent of the nose 16, and can extend from the body 12, peg 36, or handle 32 without departing from the scope of the invention. Moreover, although an alignment key 64 is disclosed, the alignment key 64 can be deleted when the cleaning bullet 10 is used in an enclosed pipe without departing from the scope of the invention.

In a preferred embodiment, the alignment key 64 includes a threaded, cylindrical, downwardly opening cavity 74 for threadably receiving a bottle top 76 of a bottle 78. The bottle 78 hangs down from the alignment key 64 and acts as a counterweight which inhibits the cleaning bullet 10 from twisting in the track. Advantageously, compressed air directed at the bottle 78 propels the cleaning bullet 10 through the track.

In use, the disposable sheet 14 is draped over the body 12 with the peg 36 extending through the sheet aperture 38. The sheet 14 is then secured relative to the body 12 by mounting the nose 16 on the peg 36 and pinching the sheet 14 between the nose 16 and front plate 42. If desired, the body 12 and/or sheet 14 can be saturated with a liquid solution that enhances cleaning and/or disinfects the interior walls of the pipe or track.

The cleaning bullet 10 is inserted into an open end of the pipe or track by grasping the handle 32 of the bullet 10 and slipping the bullet 10 into the open end of the pipe or track. If the nose 16 includes the alignment key 64, the key 64 is engaged with the slot to guide the bullet 10 in the track. The bullet 10 is then propelled through the pipe or track using methods known in the art, such as compressed air, and the like. Bottles, or other objects, normally conveyed through the pipe or track, can be inserted into the open end after insertion of the cleaning bullet 10 to push the cleaning bullet 10 ahead of the bottles, or other objects.

Figure 3:
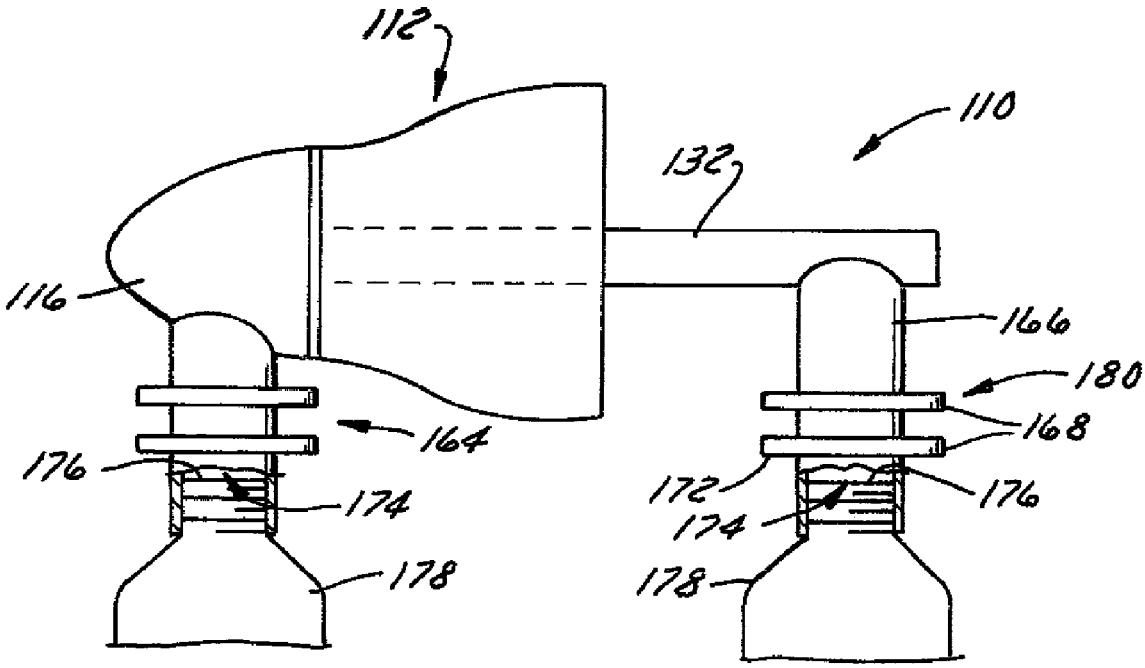
FIG. 3 is side view of an alternate embodiment of the present invention including two alignment keys.

In an alternative embodiment shown in FIG. 3, a cleaning bullet 110 has a nose 116 including a leading edge alignment key 164, a body 112, and a trailing edge alignment key 180. The body 112 is substantially identical to the body 12 shown in FIGS. 1 and 2, and is interposed between the leading edge and trailing edge alignment keys 164, 180. The leading edge alignment key 164 is substantially identical to the alignment key 64 shown in FIGS. 1 and 2, and depends downwardly from the nose 116.

The trailing edge alignment key 180 is fixed relative to the leading edge alignment key 164, such as by mounting the trailing edge alignment key 180 on a handle 132 extending rearwardly from the nose 116 through the body 112. The trailing edge alignment key 180 includes a radially extending shaft 166 extending downwardly into the longitudinal slot of the track. Spaced discs 168 formed proximal a distal end 172 of the shaft 166 engage the track in a manner similar to the objects conveyed by the air conveyor.

Preferably, both the leading edge alignment key 164 and trailing edge alignment key 180 include a threaded, cylindrical, downwardly opening cavity 174. Each cavity 174 threadably receives a bottle top 176 of a bottle 178. The bottles 178 hang down from the alignment keys 164, 180 adjacent opposing ends of the body 112 and act as counterweights which lower the center of gravity of the assembly. Advantageously, the bottles 178 inhibit the cleaning bullet 110 from twisting and tipping forward in the track.

Figure 4:
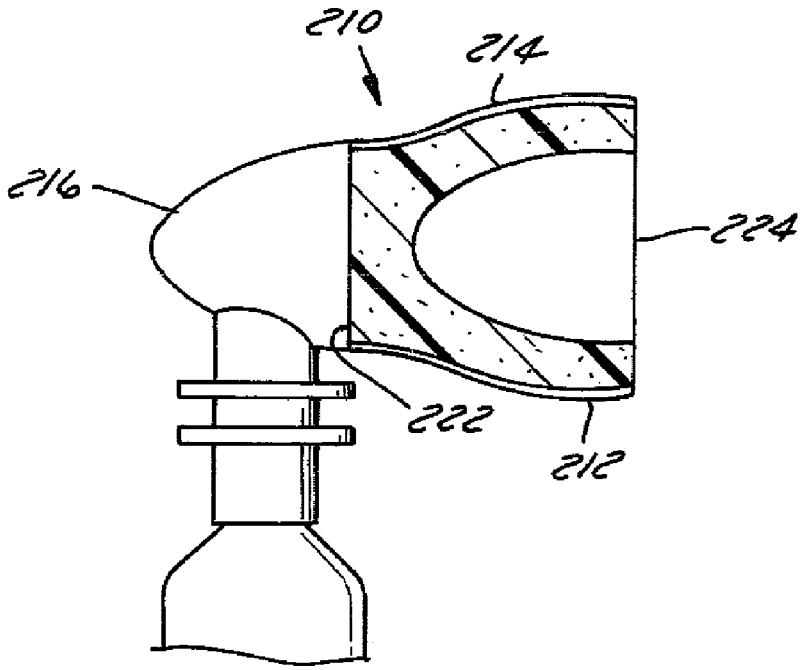
FIG. 4 is side view of an alternate embodiment of the invention including an expandable body.

In another embodiment shown in FIG. 4, a cleaning bullet 210 includes a body 212 formed from a hollow flexible material that expands to conform to the interior shape of the track. A leading end 222 of the body 212 is closed and fixed to a cleaning bullet nose 216. A trailing end 224 of the body 212 is open. Compressed air propelling the cleaning bullet 210 along the track is received in the open trailing end 224 and expands the body 212 to urge a sheet 214 against the track walls. The flexible material can be any suitable material, such as an expandable plastic, pleated non-expandable plastic, metal, cloth, or paper, and the like. Advantageously, the expandable body 212 efficiently captures the compressed air for propulsion through the track and more readily adapts to different track sizes.

Figure 5:
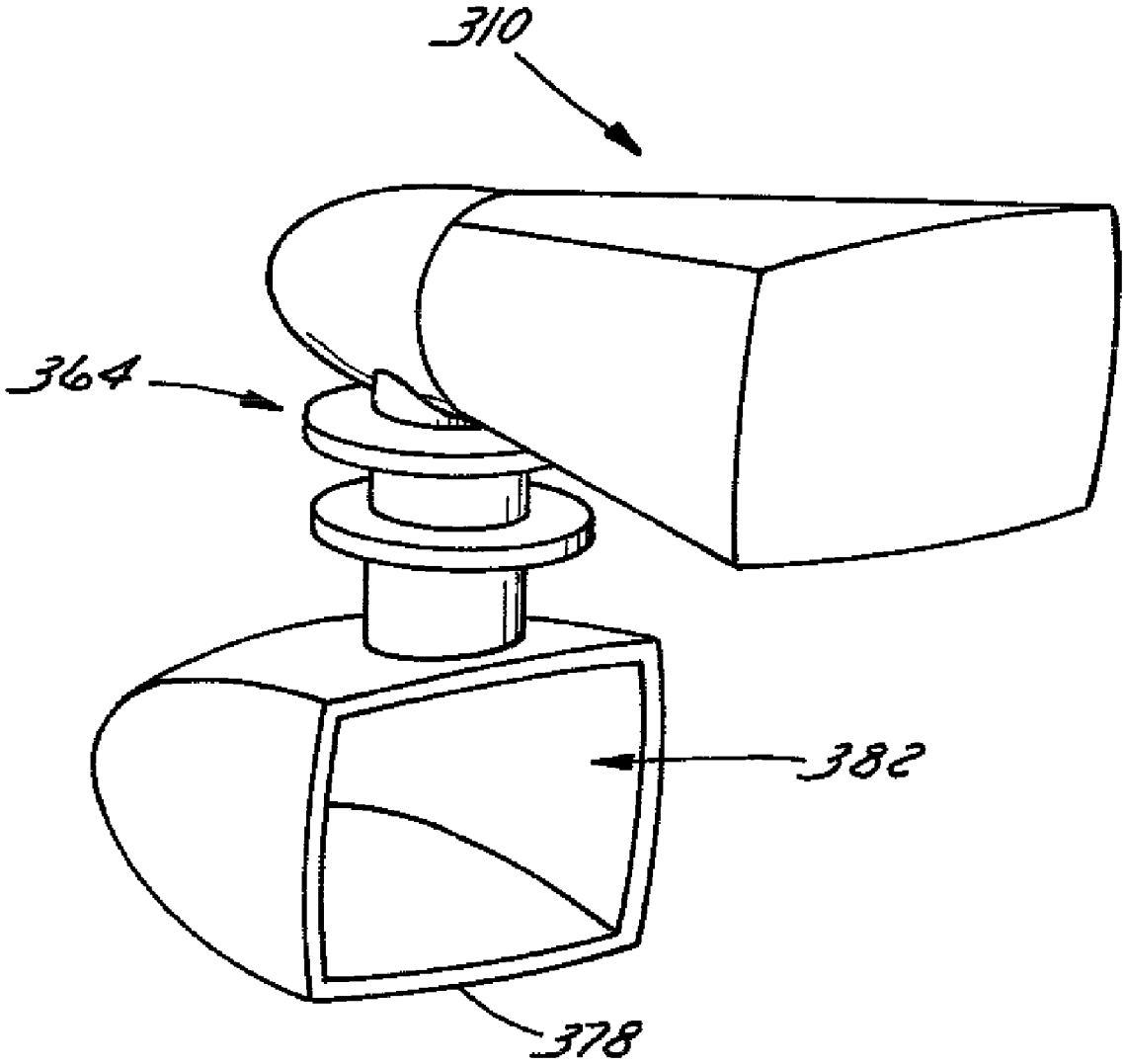
FIG. 5 is perspective view of an alternate embodiment of the invention including an air trap.
Figure 6:
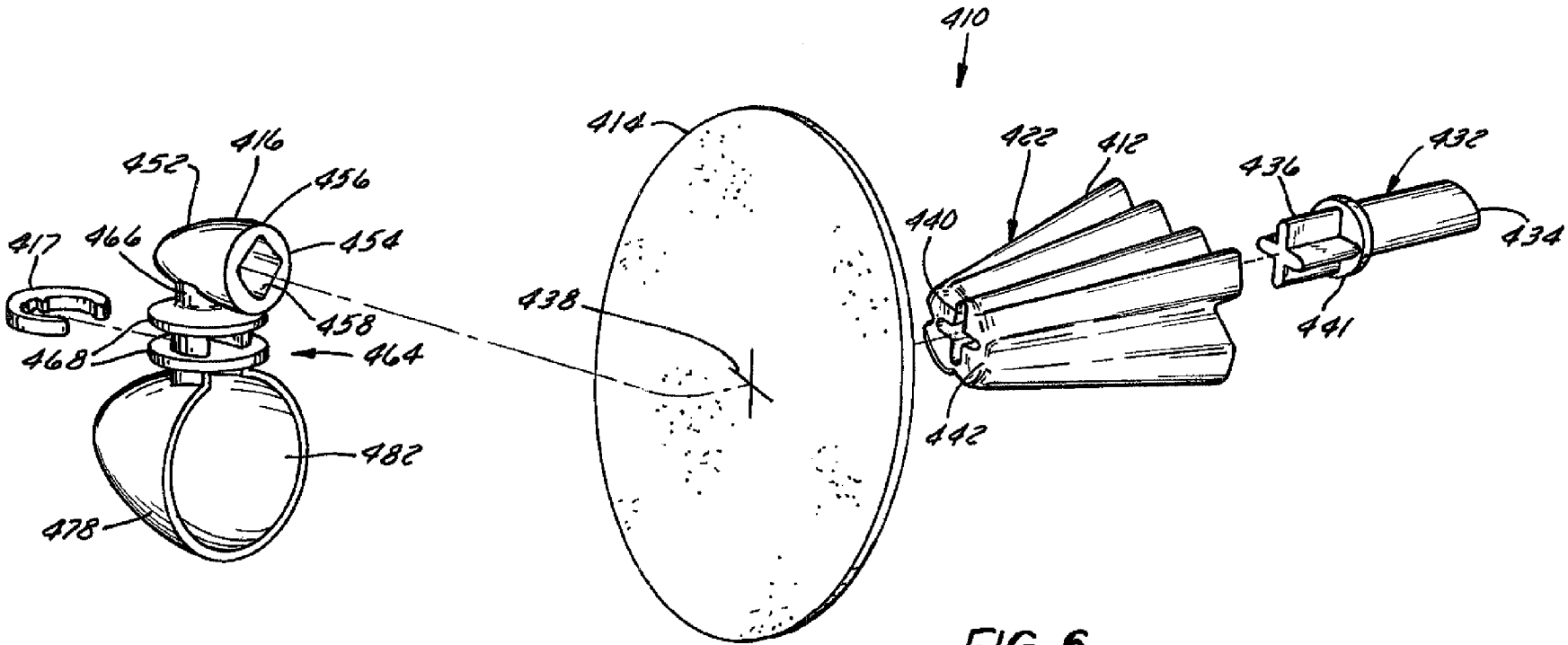
FIG. 6 is a perspective exploded view showing an alternative embodiment of the invention.

In yet another embodiment of the present invention shown in FIG. 5, a cleaning bullet 310 includes an air trap 378 extending downwardly from an alignment key 364 which captures compressed air to propel the cleaning bullet 310 along the track. The air trap 378 includes a rearwardly opening cavity 382 formed from molded plastic, paper, or other similar material with molded plastic being preferred. Preferably, the air trap 378 is formed as an integral part of the alignment key 364. However, the air trap 378 can be detachably mounted to the alignment key 364, such as the bottles described above, without departing from the scope of the invention. Advantageously, the air trap 378 propels the cleaning bullet 310 more efficiently than directing compressed air on the cleaning bullet 310 alone or with a bottle attached thereto.

Referring to FIGS. 6-12, bullet 410 has many of the same components and is assembled in a manner previously described in conjunction with bullet 10 in FIGS. 1 and 2. It also operates in the same manner. The major difference is that it has a pleated, hollow, undulating body 412 covered by disposable sheet 414. Pleated body 412 has a leading edge 422 and is connected to front plate 442 having a cruciform slot 440 through which is fitted peg 436 of rod 434 constituting handle 432. Aperture 438 is die cut through the sheet 414 and receives the peg 436 to locate and fix the sheet 414 relative to body 412. The front plate 442 couples the body 412 to the nose 416 with sheet 414 draped thereover. Peg 436 engages receptacle 458 of the trailing end 456 of nose 416, which includes the leading end 452. As in bullet 10, a track alignment key 464 having spaced disks 468 is positioned between nose 416 and air trap 478 with opening cavity 482. A shaft 466 provides connection to nose 416.

Figure 7:
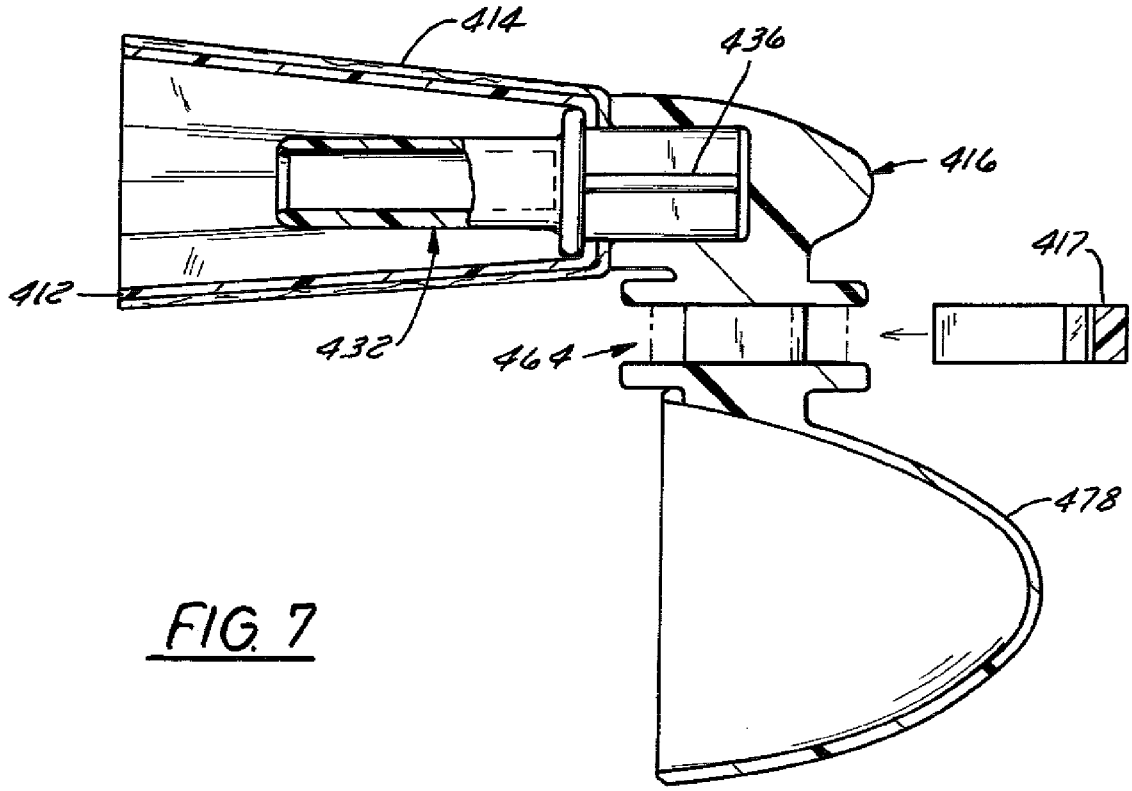
FIG. 7 is a side view of the assembled embodiment shown in FIG. 6.
Figure 8:
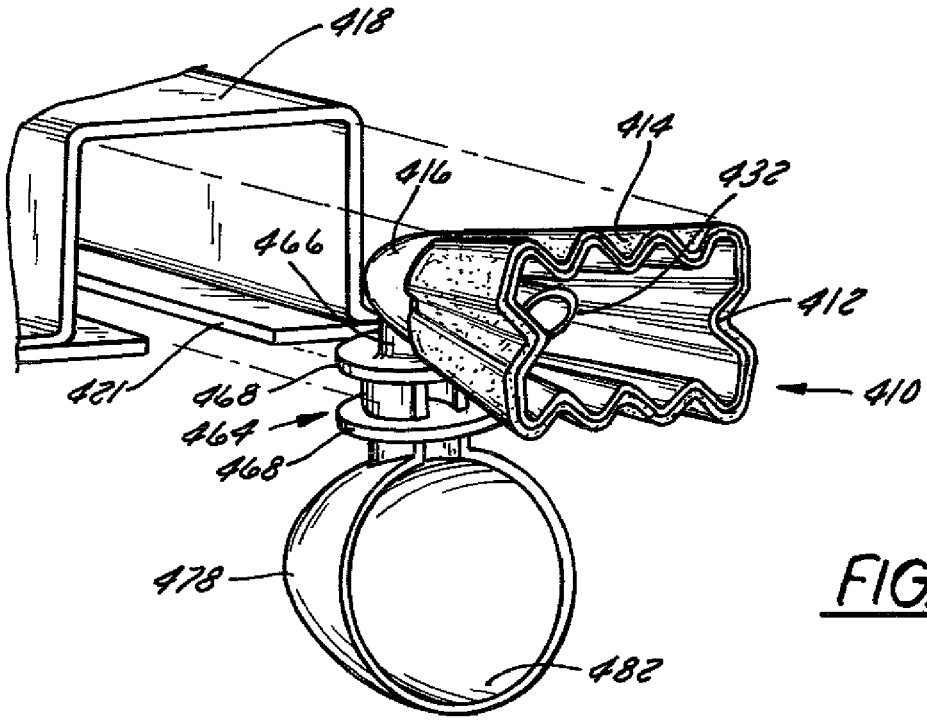
FIG. 8 is a perspective view of the embodiment shown in FIG. 7 positioned for insertion into a track.
Figure 9:
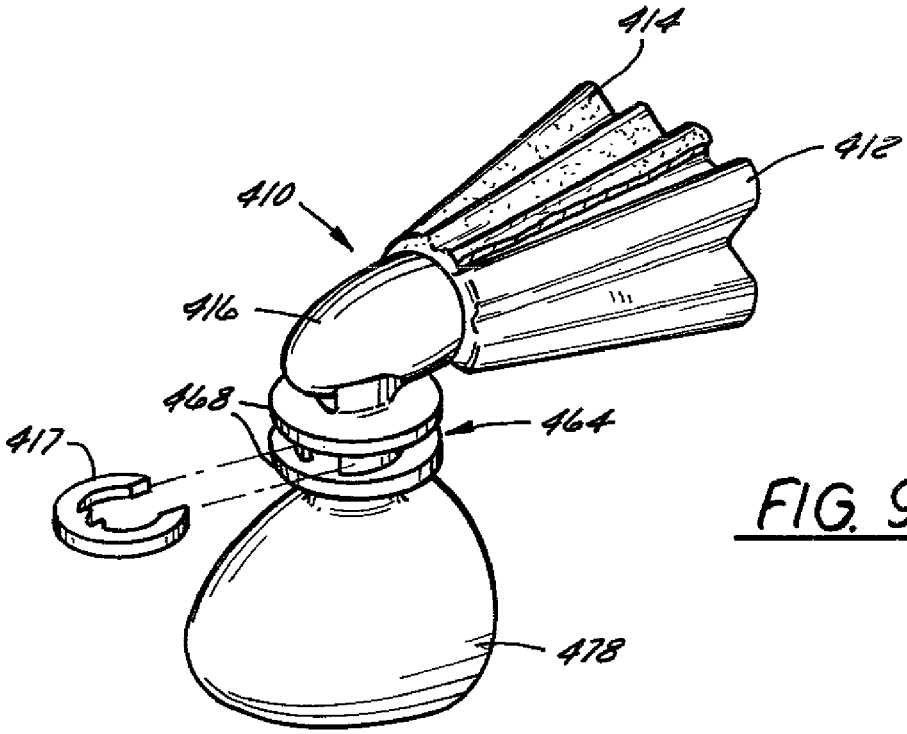
FIG. 9 is a perspective view of the embodiment shown in FIG. 7.
Figure 10:
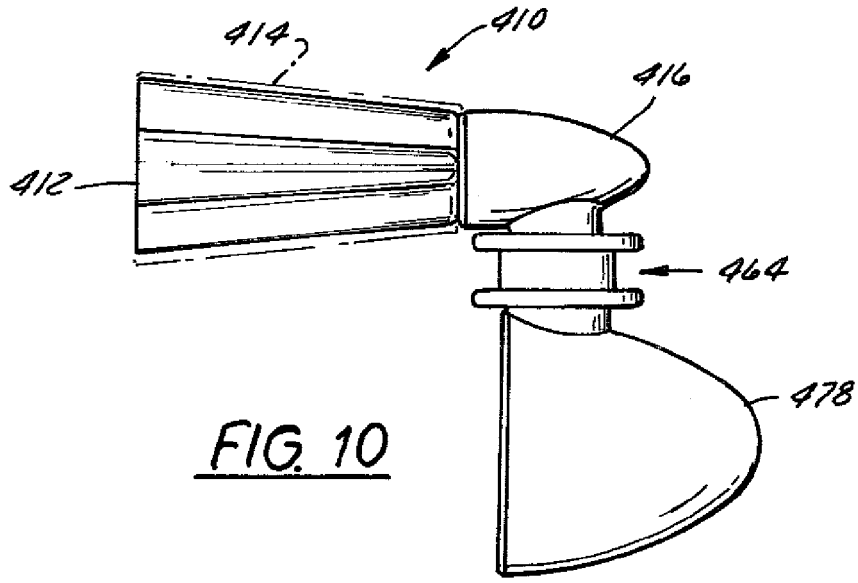
FIG. 10 is a side view of the embodiment shown in FIG. 7.
Figure 11:
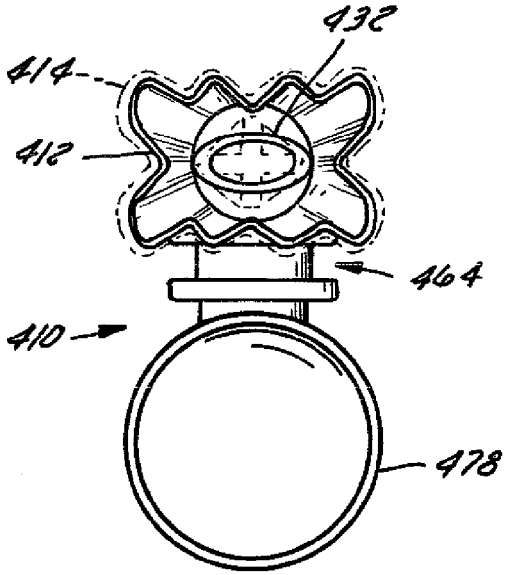
FIG. 11 is a rear view of the embodiment shown in FIG. 7
Figure 12:
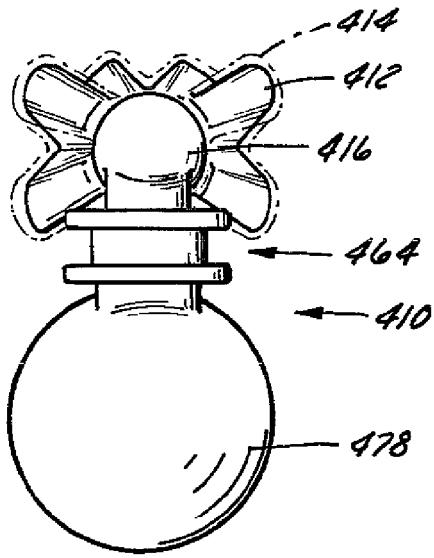
FIG. 12 is a front view of the embodiment shown in FIG. 7.

As illustrated in FIGS. 7 and 9, a track adapter 417 fits between disks 468 for track adjustment purposes. It would be employed to shorten the diameter of the gap between the spaced disks 468.

Figure 13:
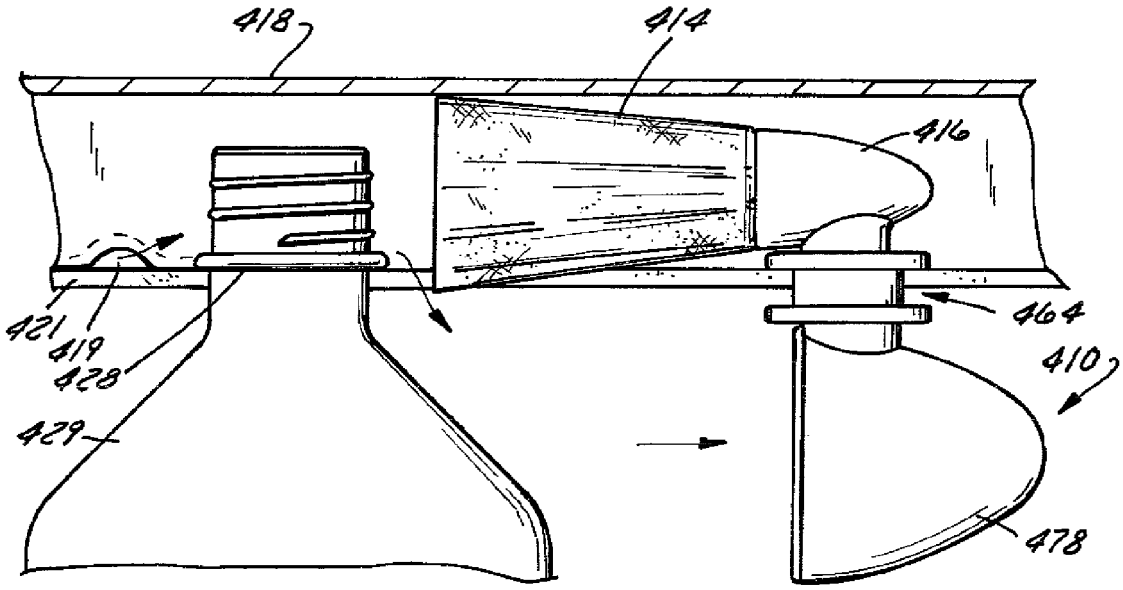
FIG. 13 is a side view of the embodiment shown in FIG. 7 in a track with a bottle.
Figure 14:
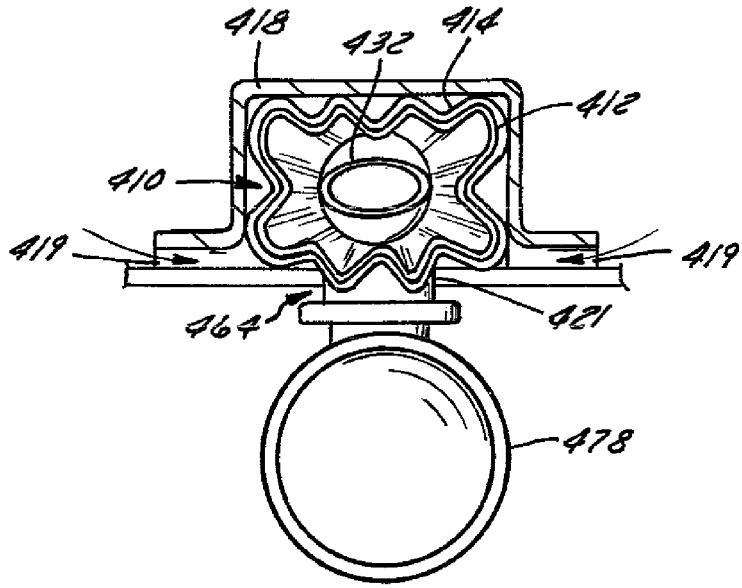
FIG. 14 is an end view of the embodiment shown in FIG. 7 as positioned in the track shown in FIG. 13.
Figure 15:
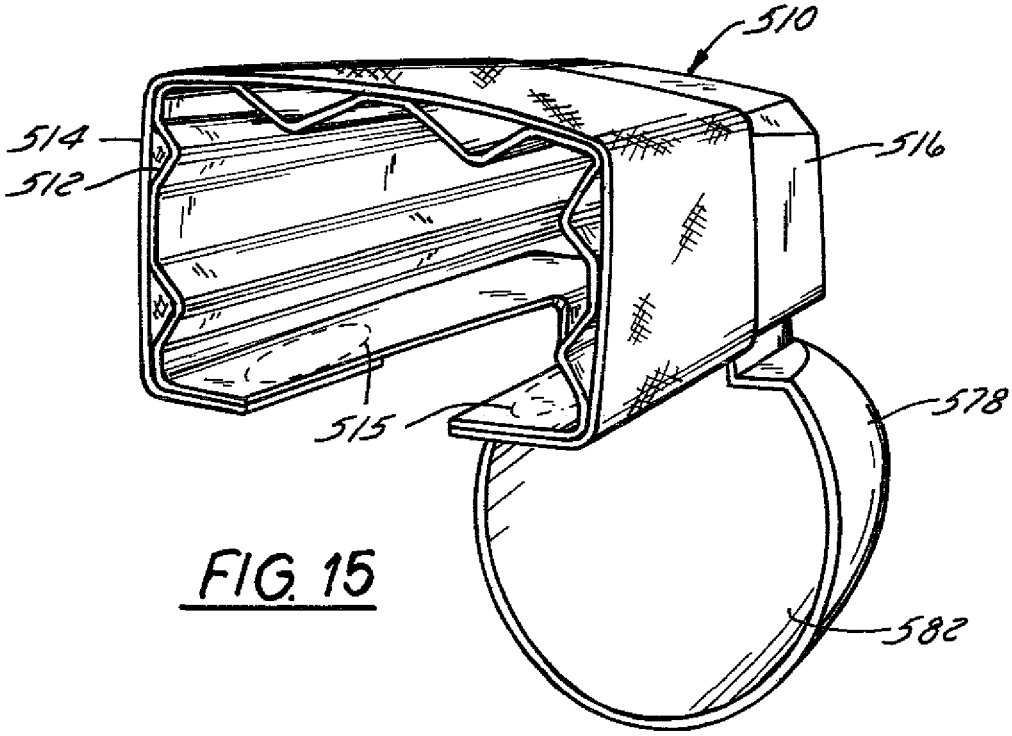
FIG. 15 is a perspective view of an alternative embodiment.

FIGS. 13 and 14 illustrate the positioning of bullet 410 in track 418. Alignment key 464 is positioned to ride in track 418. A bottle 479 with flange 428 is also positioned in track 418 in the usual manner and rides in slot 421. Air is forced into track 418 through the air inlet 419 to engage and expand body 412 and force sheet 414 against the inside of track 418. The air engaging body 412 propels it through the tract 418. Air exits slot 421 to engage air trap 478 to also propel body 412 through track 418. Air also engages the neck 477 of bottle 479 to propel it through track 418. An air conveyor system for plastic bottles which can work well is the Posijet air conveyor available from Posimat of Miami, Fla.

The bullet 510 shown in FIGS. 15-18 does not employ the handle 32 for connecting the pleated body 512 to the nose 516. Instead, body 512 is preferably secured to nose 516 with an adhesive with placement of a portion in the cavity 535. If desired, body 512 could be attached to nose 516 such by molding, a snap fitment or other suitable means. Sheet 514 is then secured to body 512 such as by heat welding as indicated at 515. Bullet 510 includes the air trap 578 with cavity 582.

Figure 16:
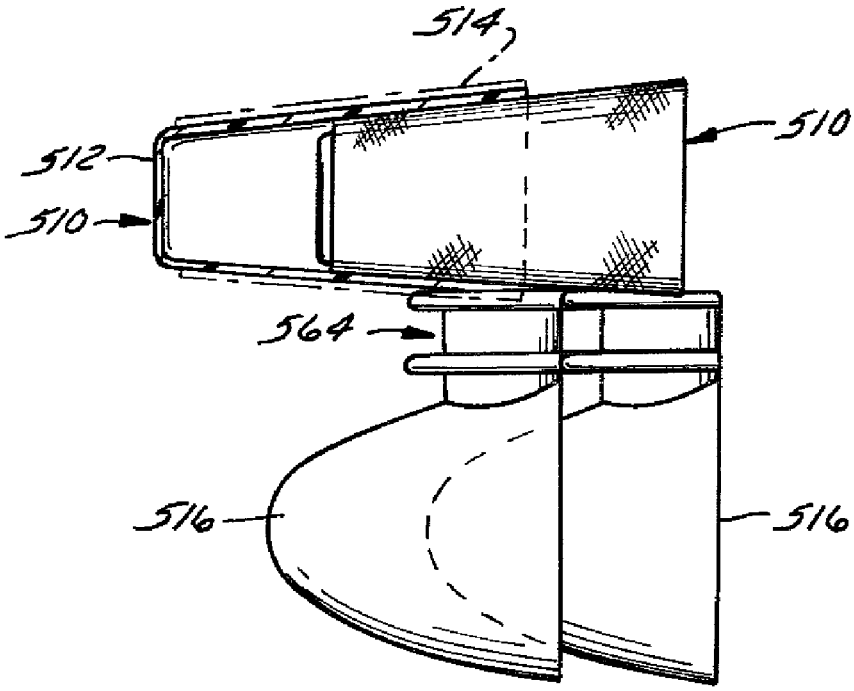
FIG. 16 is a side view showing the embodiment of FIG. 15 in a nesting condition.
Figure 17:
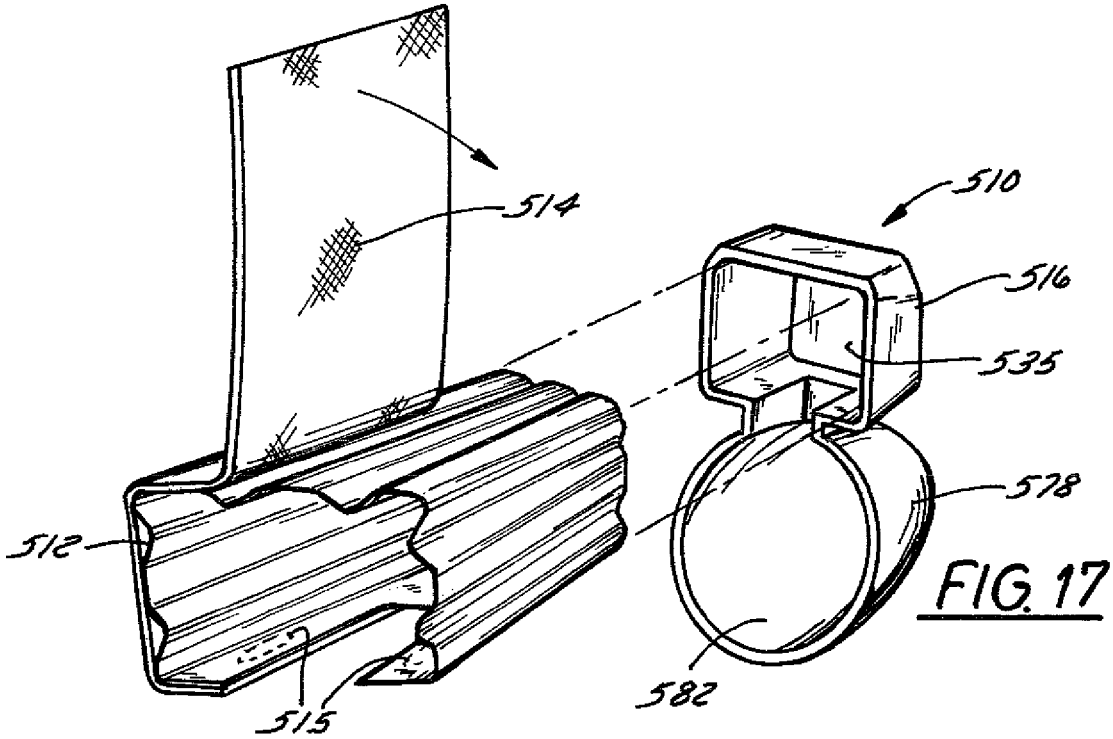
FIGS. 17-18 are perspective views illustrating the fabrication of the embodiment shown in FIG. 15.
Figure 18:
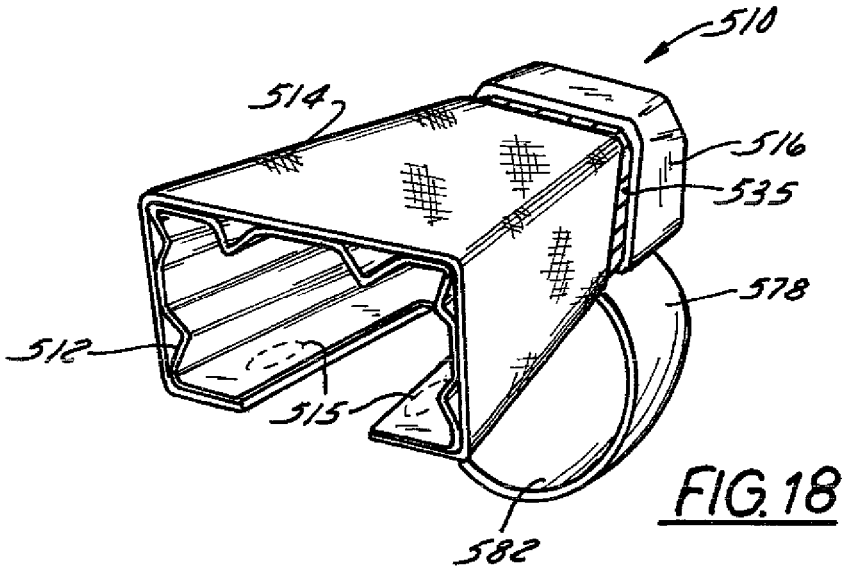
Figure 20:
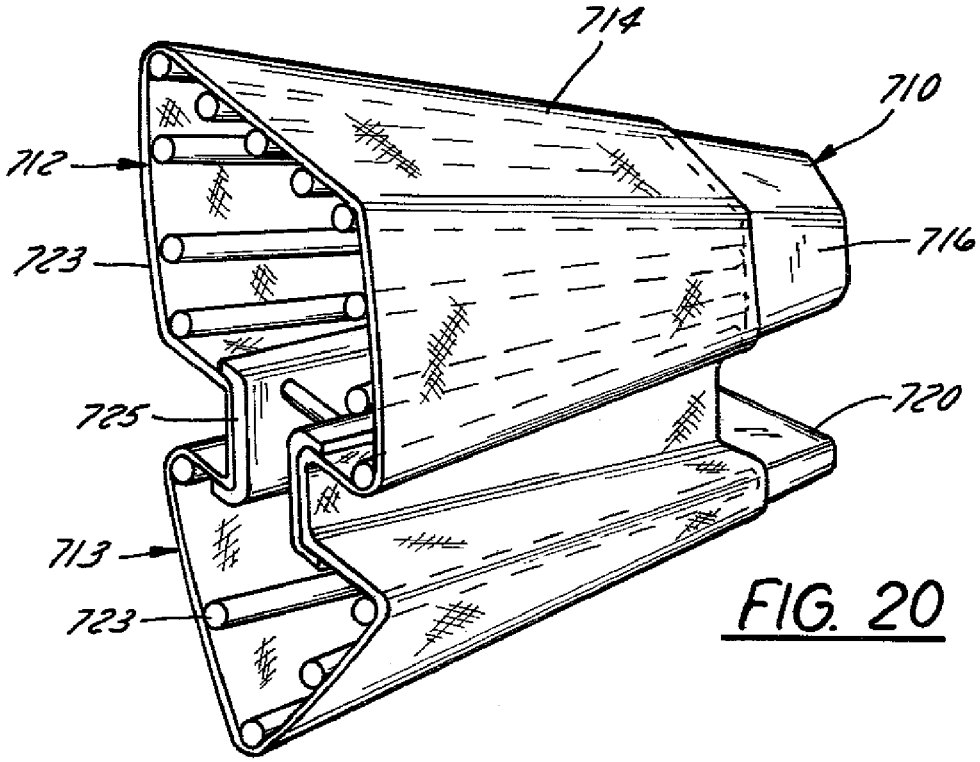
FIG. 20 is a perspective view of an alternative embodiment.

FIG. 16 illustrates the nesting of bullets 510. This provides a packaging and storage advantage.

Figure 19:
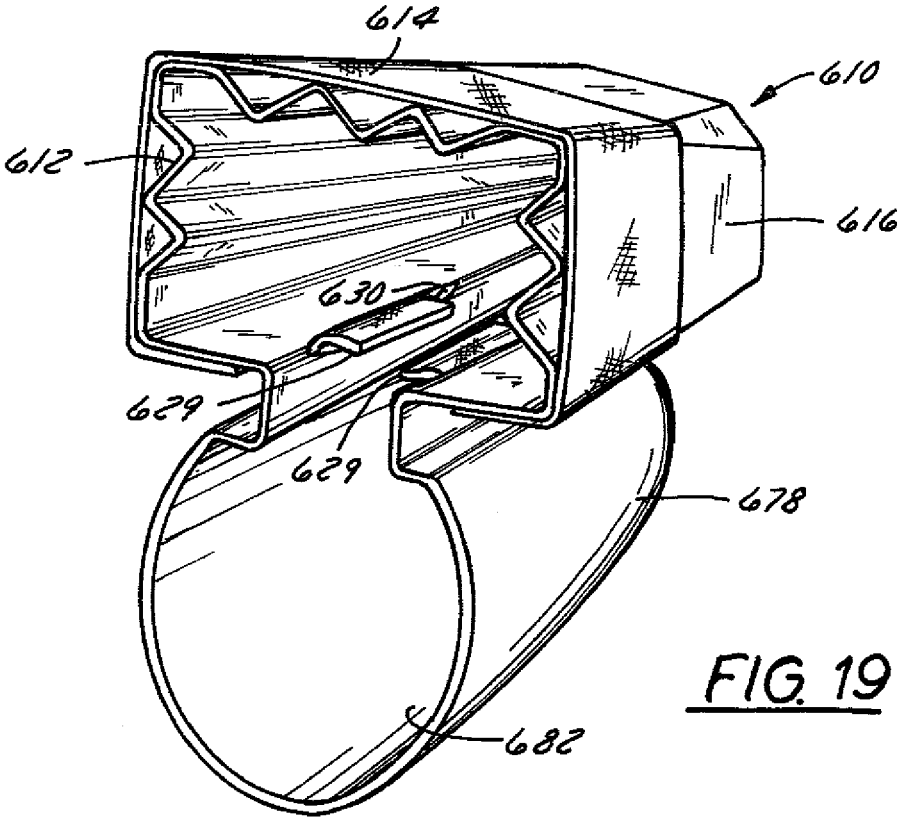
FIG. 19 is a perspective view of an alternative embodiment.

FIG. 19 shows another bullet 610 wherein the air trap 678 with cavity 682 is formed separately from the body 612. It is attached thereto by means of the flanges 629 passing through the slots 630 provided in body 612. Sheet 614 is adhesively secured to body 612.

FIGS. 20-23 illustrate still another embodiment 710 with two body portions 712 and 713. Rod or support members 723 are integrally molded to noses 716 and 720. A connecting section 725 connects noses 716 and 720 by means of the flanges 731 in both noses 716 and 720 and slots 727 in the connecting section. The U-shaped side rails 748 provide engagement surfaces for riding in a track such as 418 shown in FIG. 8. Sheet 714 covers the rods 723.

Figure 21:
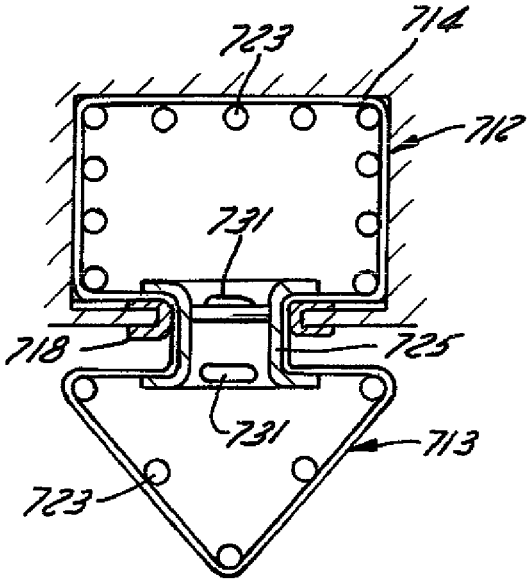
FIG. 21 is an end view of the embodiment shown in FIG. 20 positioned in a track.
Figure 22:
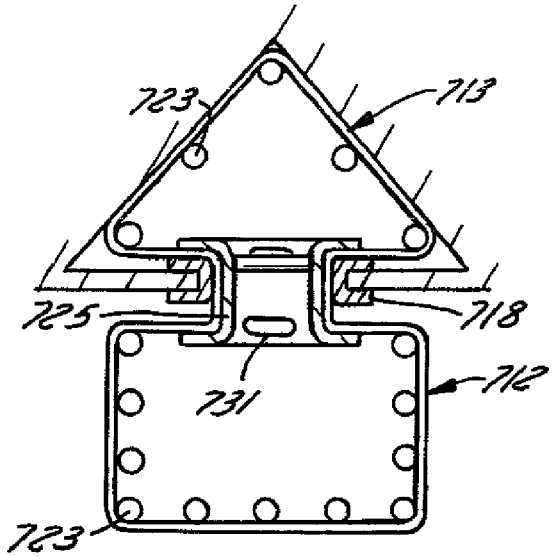
FIG. 22 is a view similar to FIG. 21 illustrating the embodiment of FIG. 21 in a different mode of operation than that shown in FIG. 21.
Figure 23:
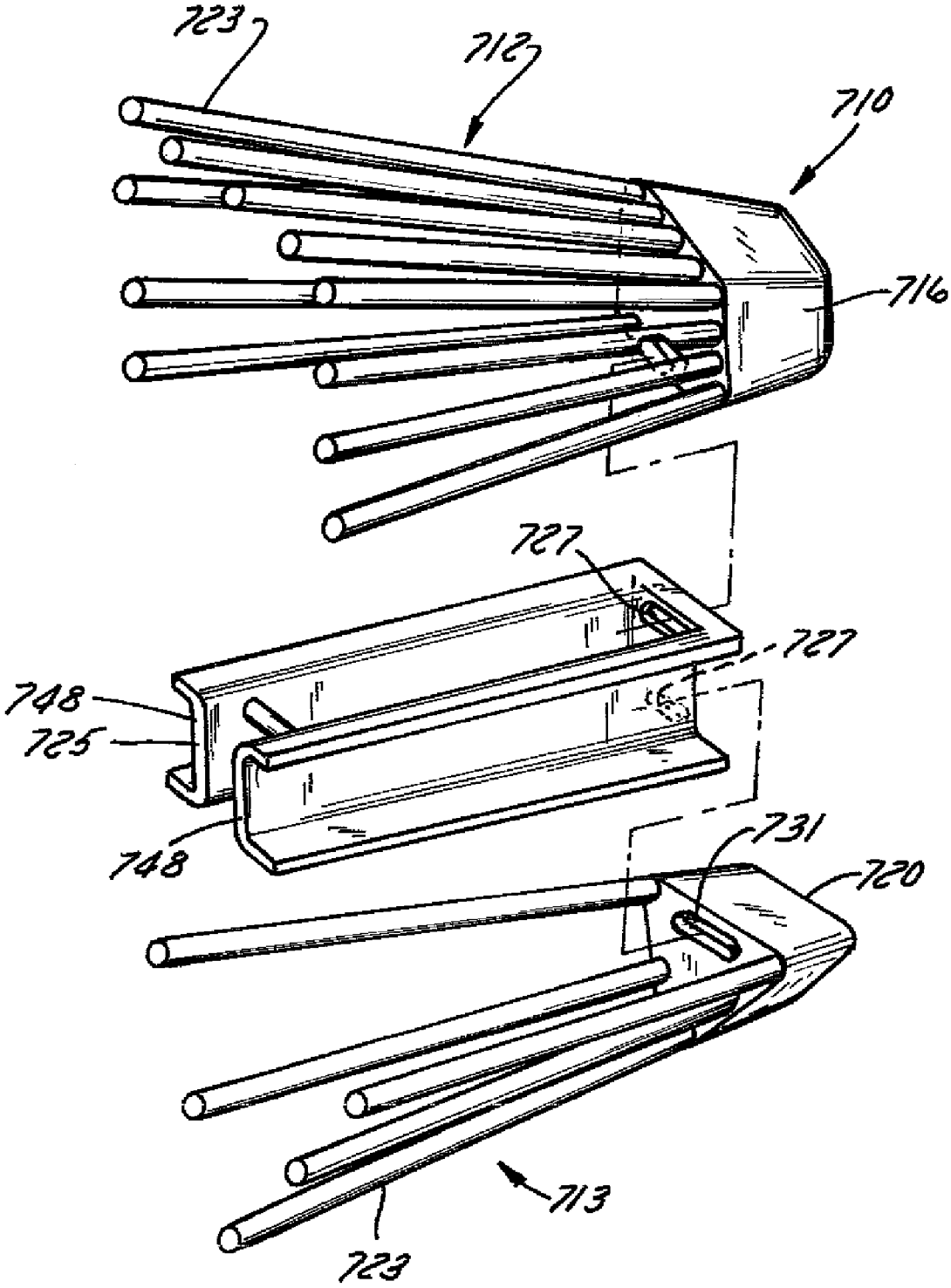
FIG. 23 is a perspective exploded view showing the assembly of the embodiment shown in FIG. 20.

Bullet 710 with two bodies 712 and 713 of different geometric configurations offers the advantage of placement in tracks of different geometric configurations such as a rectangular one into which body 712 would be placed and a triangular one into which body 713 would be placed. This is illustrated in FIGS. 21 and 22. Those body portions 712 and 713 not placed in the tracks serve as air traps.

As stated previously, sheet 14 is formed from a micro fiber material. Other alternative materials are also stated. All of the other described sheets are made of the same absorbent material. All of the sheets can include a fluid absorbed by the sheet for wiping onto the interior of a pipe or a track. The sheets can be pre-saturated with the fluid or the fluid can be applied immediately before use such as by spraying. All of the noses such as 16, as well as the connected components such as shafts and spaced disks are molded from polypropylene, urethane, styrene or any other similar plastic. All of the air traps are also preferably formed from a similar molded material as well as rod members 723. All of the air traps serve the same function of capturing compressed air to propel the bullets. They also serve as a counterweight for the bodies. It will be appreciated that in place of the air traps a bottle can be employed as previously described or a partial bottle. The pleated bodies such as 412 are preferably formed from a styrene plastic material, however, other plastic materials having the same or similar properties could be used, as well as cardboard, paper and thin metal.

While there has been shown and described what is at present considered the preferred embodiment of the invention, it will be obvious to those skilled in the art that various changes and modifications can be made therein without departing from the scope of the invention defined by the appended claims. For example, the embodiment disclosed herein includes a body draped with a disposable sheet. Alternative embodiments can include a nondisposable sheet that is reused or the entire device including the body can be disposable without departing from the scope of the invention.

What is claimed is:

1. A cleaning bullet for use in a pipe or track, said bullet comprising:

a compressible pleated, hollow, undulating body having a leading end and a trailing end, said body defining an axis extending between said leading end and said trailing end; and a sheet draped over said leading end and fixed relative to said body, said compressible body urging said sheet against an interior wall of the pipe or track.

2. The cleaning bullet as in claim 1, including a nose detachably fixed relative to said body forwardly of said leading end, said sheet being interposed between said nose and said body.

3. The cleaning bullet as defined in claim 2 wherein the sheet is fastened to the nose by a handle.

4. The cleaning bullet as defined in claim 2 telescoped into another cleaning bullet of the same structure configuration.

5. The cleaning bullet as in claim 1, including a first alignment key extending radially relative to said axis for engagement with a slot formed in the track.

6. The cleaning bullet as in claim 5 including a second alignment key extending radially relative to said axis for engagement with a slot formed in the track, wherein said body is interposed between said first and second alignment keys.

7. The cleaning bullet as defined in claim 5 further including an adapter for positioning in the alignment key.

8. The cleaning bullet as in claim 1, in which said body is formed from an absorbent material.

9. The cleaning bullet as in claim 8, including a fluid absorbed by said body for wiping onto said interior wall of the pipe or track.

10. The cleaning bullet as in claim 1, including a counterweight fixed relative to said body.

11. The cleaning bullet as on claim 10, in which said counterweight is a bottle detachable fixed to said cleaning bullet.

12. The cleaning bullet as in claim 1, including an air trap which captures compressed air to propel said cleaning bullet.

* * * * *